US007748712B2

(12) United States Patent
Sobel et al.

(10) Patent No.: US 7,748,712 B2
(45) Date of Patent: Jul. 6, 2010

(54) TACTILE SCRATCH MEDIA APPARATUS AND METHOD

(75) Inventors: William David Sobel, Oakland, CA (US); William T. Stopford, Walnut Creek, CA (US)

(73) Assignee: Loyal Commerce Systems, Inc., San Ramon, CA (US)

( * ) Notice: Subject to any disclaimer, the term of this patent is extended or adjusted under 35 U.S.C. 154(b) by 905 days.

(21) Appl. No.: 11/398,106

(22) Filed: Apr. 5, 2006

(65) Prior Publication Data

US 2007/0235926 A1 Oct. 11, 2007

(51) Int. Cl.
*A63B 71/00* (2006.01)

(52) U.S. Cl. ..... 273/138.1; 283/903

(58) Field of Classification Search ..... 345/168, 345/173, 174, 175; 361/751; 283/106, 901, 283/903; 273/138.1, 139, 269
See application file for complete search history.

(56) References Cited

U.S. PATENT DOCUMENTS 4,993,753 A * 2/1991 Weeks ..... 283/102
5,857,911 A * 1/1999 Fioretti ..... 463/40

* cited by examiner

*Primary Examiner*—Chanh Nguyen
*Assistant Examiner*—Calvin C Ma
(74) *Attorney, Agent, or Firm*—Raj Abhyanker LLP

(57) ABSTRACT

A tactile scratch media apparatus and method are disclosed. In one embodiment, an apparatus includes a scratch media having a tactile data pattern to provide information to a user and a scratch region on the scratch media having a plurality of layers that conceal the tactile data pattern. The tactile data pattern may include a raised tactile data and/or an indented tactile data. The raised tactile data and the indented tactile data may be a braille character, an alphanumerical character and/or a tangible data. The surface edge of the raised tactile data and/or the indented tactile data of the tactile data pattern may be curved. The tactile data pattern may be arranged according to an overlapping pattern arrangement and/or a non-overlapping pattern arrangement. The arrangement of the overlapping pattern arrangement and the non-overlapping pattern arrangement may be based on a combination of a print data and the raised tactile data and/or the indented tactile data.

2 Claims, 10 Drawing Sheets

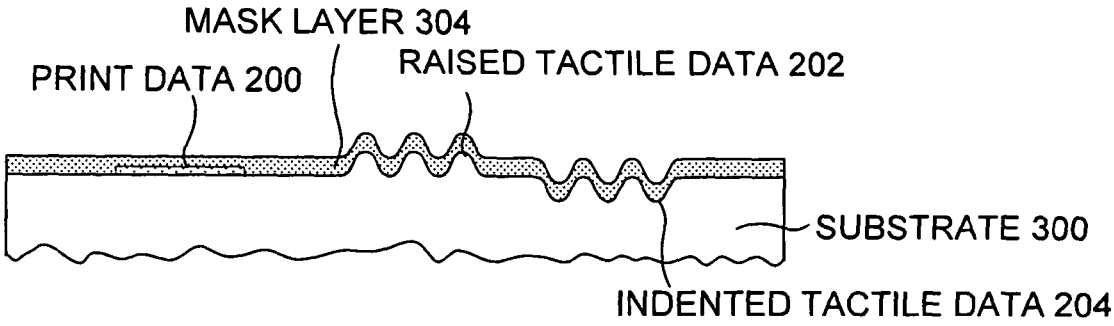
FIGURE 3D I
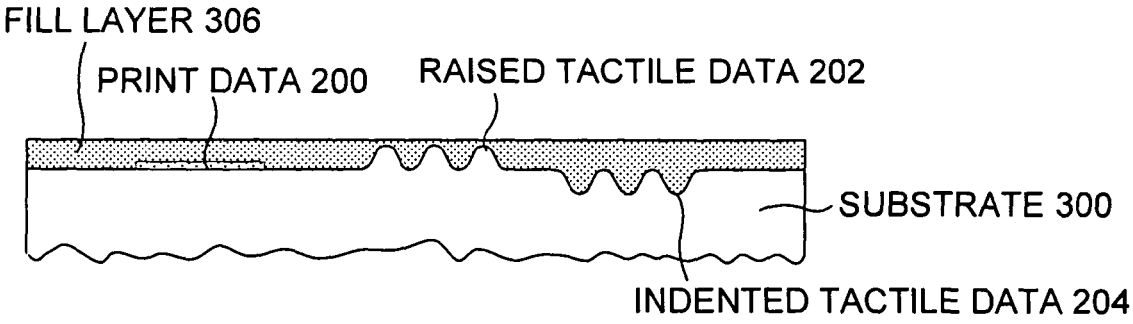
FIGURE 3D II

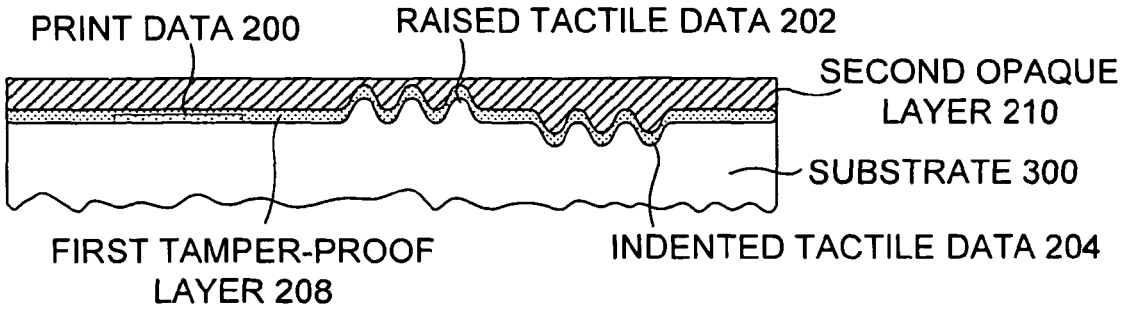
FIGURE 3E I
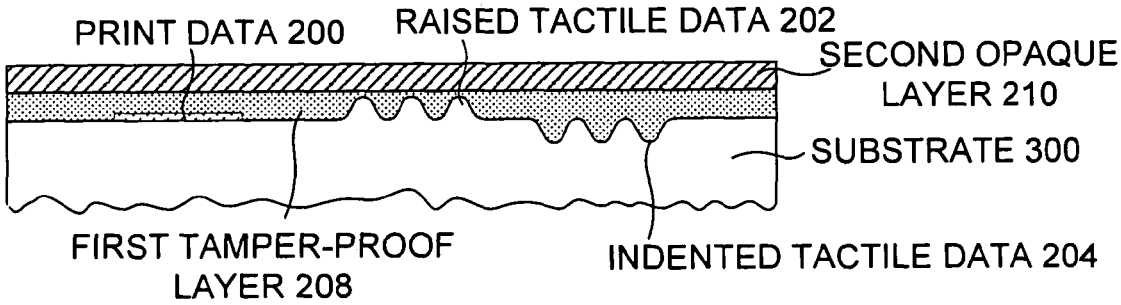
FIGURE 3E II

TACTILE SCRATCH MEDIA APPARATUS AND METHOD

FIELD OF TECHNOLOGY

This disclosure relates generally to the technical fields of and, in one example embodiment, to a tactile scratch media apparatus and method

BACKGROUND

A gaming provider (e.g., California State Lottery™, PokerStars™, etc.) may provide a gaming service (e.g., game of chance, game of skill, etc.) to a user (e.g., a player). However, the gaming service may not be accessible to a special-needs user (e.g., a person with physical and/or mental impairments). The special-needs user may wish to access the gaming service but may be unable participate in the gaming service because information presented by the gaming service may not be accessible to the special-needs user (e.g., the special-needs user may not be able to perceive data presented in the gaming service because the special-needs user may not be able to visualize and/or hear a game). In addition, a market size of the gaming service may be limited due to a lack of accessibility by special-needs users.

The gaming provider may need to validate (e.g., verify or check) the authenticity of a winner (e.g., by checking the authenticity of a gaming media). Verification of the gaming media may be based on an optical evaluation of a printed game data (e.g., a visual verification of the game result present on the gaming media). Validation of the gaming media based on observation of printed data alone may have inaccuracies as the printed data may be subject to manipulation and/or foul play (e.g., due to tampering of the printed data). This may cause the user (e.g., the player) to lose faith in the gaming provider and/or the gaming service.

SUMMARY

A tactile scratch media apparatus and method are disclosed. In one aspect, an apparatus includes a scratch media having a tactile data pattern to provide information to a user and a scratch region on the scratch media having a plurality of layers that conceal the tactile data pattern. The tactile data pattern may include a raised tactile data and/or an indented tactile data. The raised tactile data and the indented tactile data may be a braille character, an alphanumerical character and/or a tangible data. The surface edge of the raised tactile data and/or the indented tactile data of the tactile data pattern may be curved. The tactile data pattern may be arranged according to an overlapping pattern arrangement and/or a non-overlapping pattern arrangement. The arrangement of the overlapping pattern arrangement and the non-overlapping pattern arrangement may be based on a combination of a print data and at least one of the raised tactile data and the indented tactile data.

A first tamper-proof layer of the plurality of layers may cover the print data, the raised tactile data and/or the indented tactile data to prevent tampering of the tactile data pattern. The first tamper-proof layer may be a mask layer and/or a fill layer. A second opaque layer of the plurality of layers may cover the first tamper-proof layer, the print data, the raised tactile data and/or the indented tactile data to prevent detection of the tactile data pattern. Thickness of the second opaque layer may be greater than a thickness of the raised tactile data.

In another aspect, a method includes creating a tactile data pattern having a raised tactile data and/or an indented tactile data on a scratch media and securing the tactile data pattern on the scratch media based application of a plurality of layers on the tactile data pattern. The tactile data pattern may be created based on application of an etching technique, an indenting technique, a printing technique and/or an embossing technique on the scratch media. An overlapping pattern arrangement and/or a non-overlapping pattern arrangement of the tactile data pattern may be generated based on a combination of a print data and at least one of the raised tactile data and the indented tactile data.

The tactile data pattern on the scratch media may be protected based on application of a first tamper-proof layer of the plurality of layers on the tactile data pattern. Application of the first tamper-proof layer may be on top of the print data, the raised tactile data and/or the indented tactile data. The tactile data pattern on the scratch media may be concealed based on application of a second opaque layer of the plurality of layers on the tactile data pattern. Application of the second opaque layer may be subsequent to the application of the first tamper-proof layer. Application of the second opaque layer may be on top of the first tamper-proof layer, the print data, the raised tactile data and/or the indented tactile data.

In yet another aspect, a method of conducting a game includes providing a scratch media having a tactile data pattern to disclose a game outcome to a user and verifying a winner based on a validation of the game outcome associated to the tactile data pattern. The validation of the game outcome may be based on a comparison of an optical evaluation of a print data with a tactile evaluation of a raised tactile data and/or an indented tactile data of the tactile data pattern.

In yet another aspect a scratch media assembly includes a print data printed above a substrate media, a tactile data pattern formed on the substrate media, a first tamper-proof layer formed above the tactile data pattern and a second opaque layer formed above the first tamper-proof layer and above the tactile data pattern.

The methods, systems, and apparatuses disclosed herein may be implemented in any means for achieving various aspects, and may be executed in a form of a machine-readable medium embodying a set of instructions that, when executed by a machine, cause the machine to perform any of the operations disclosed herein. Other features will be apparent from the accompanying drawings and from the detailed description that follows.

BRIEF DESCRIPTION OF THE DRAWINGS

Example embodiments are illustrated by way of example and not limitation in the figures of the accompanying drawings, in which like references indicate similar elements and in which:

FIG. 3A-3E are process diagrams illustrating fabrication of the scratch region on the scratch media, according to one embodiment.

Figure 1:
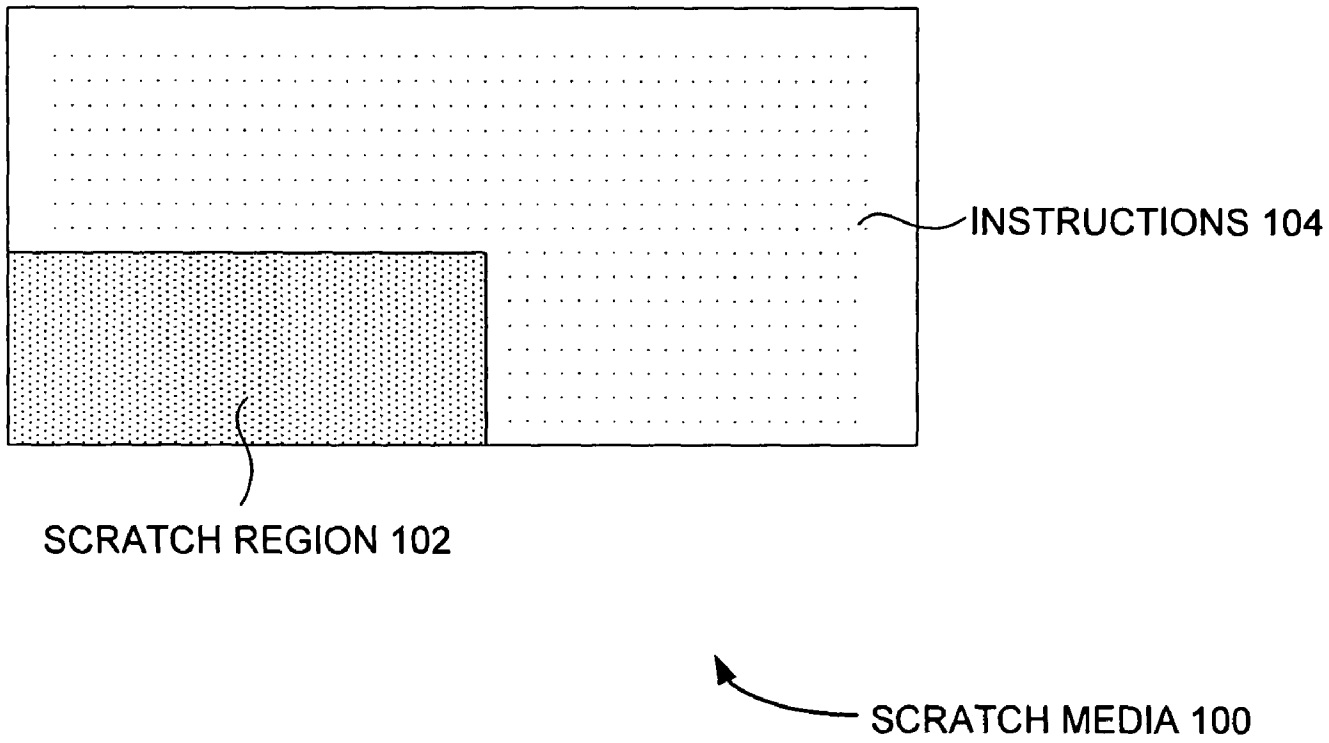
FIG. 1 is a front view of a scratch media having a scratch region, according to one embodiment.

Other features of the present embodiments will be apparent from the accompanying drawings and from the detailed description that follows.

DETAILED DESCRIPTION

A tactile scratch media apparatus and method are disclosed. In the following description, for the purposes of explanation, numerous specific details are set forth in order to provide a thorough understanding of the various embodiments. It will be evident, however to the one skilled in the art that the various embodiments may be practiced without these specific details. An example embodiment provides methods and systems for an apparatus including a scratch media (e.g., a scratch card, a scratch paper, etc.) having a tactile data pattern (e.g., a tactile data pattern 206 of FIG. 2) to provide information (e.g., information related to a lottery, a game, banking password, etc.) to a user and a scratch region (e.g., a scratch region 102 of FIG. 1) on the scratch media (e.g., a scratch media 100 of FIG. 1) having a plurality of layers (e.g., a first tamper-proof layer 208 and a second opaque layer 210 of FIG. 2) that conceal the tactile data pattern.

Another example embodiment provides methods and systems to create a tactile data pattern (e.g., the tactile data pattern 206 of FIG. 2) having a raised tactile data (e.g., a raised tactile data 202 of FIG. 2) and/or an indented tactile data (e.g., an indented tactile data 204 of FIG. 2) on a scratch media and to secure the tactile data pattern on the scratch media based on application of a plurality of layers on the tactile data pattern.

A yet another example embodiment provides methods and systems to provide a scratch media (e.g., the scratch media 100 of FIG. 1) having a tactile data pattern to disclose a game outcome (e.g., result of a game) to a user (e.g., a player) and to verify a winner based on a validation (e.g., check for authenticity) of the game outcome associated to the tactile data pattern.

FIG. 1 is a front view of a scratch media 100 having a scratch region 102 and instructions 104. The scratch region 102 may be a region on a scratch media (e.g., a lottery card, a sweepstakes card, etc.) having a tactile data pattern 206 (e.g., the tactile data pattern 206 of FIG. 2) that may be concealed by a plurality of layers according to one embodiment. The plurality of layers may be removed (e.g., removed my abrasion, scratching, etc.) to reveal information (e.g., confidential information, information related to a lottery, a game, banking password, etc.) associated to the tactile data pattern. Instructions 104 may be instructions (e.g., information to understand a game, a service, etc.) present on the scratch media 100.

Figure 2:
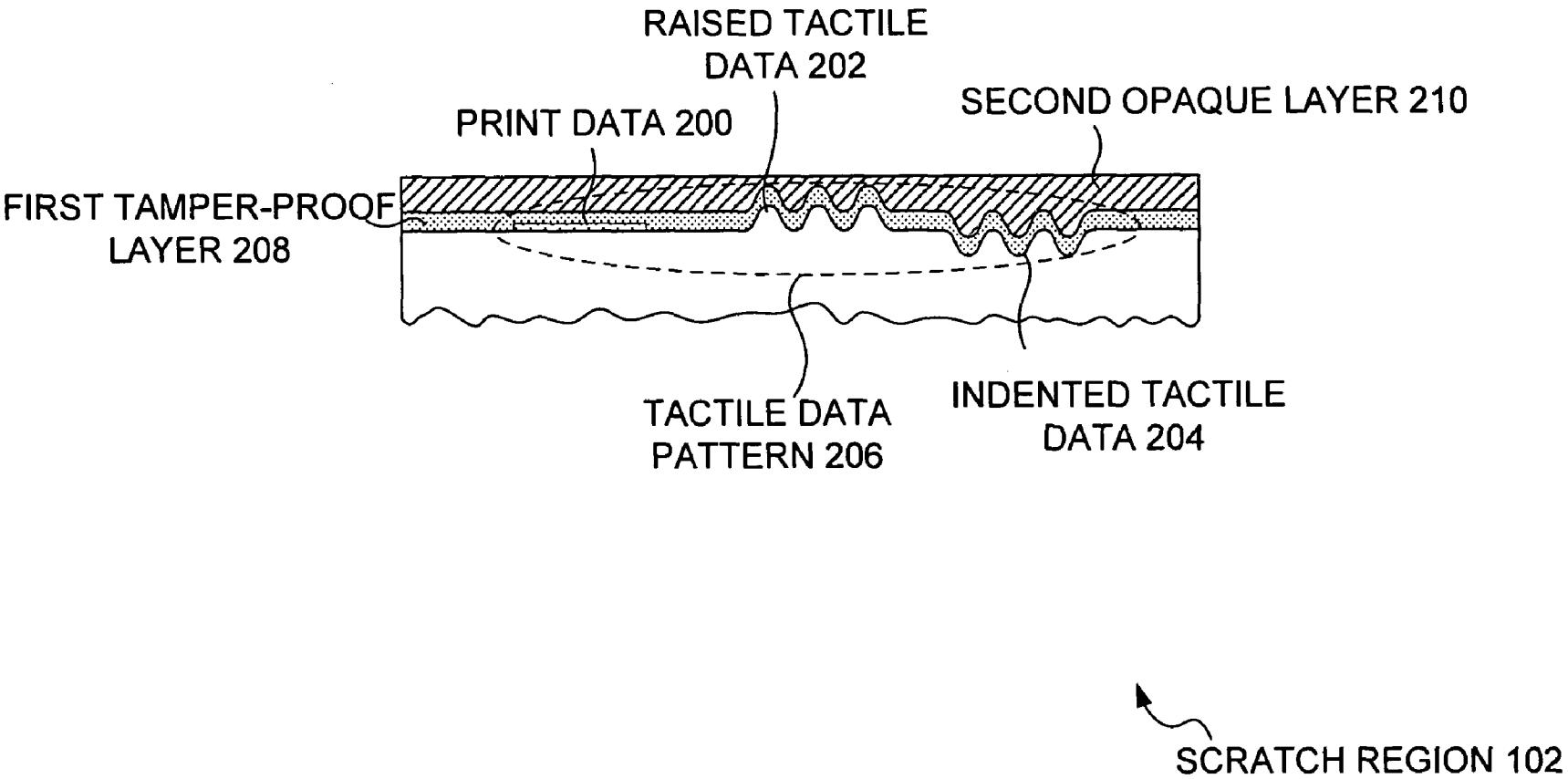
FIG. 2 is an exploded cross-sectional view of the scratch region of FIG. 1, according to one embodiment.

FIG. 2 is an exploded cross section view of the scratch region 102 of FIG. 1 having a print data 200, a raised tactile data 202, an indented tactile data 204, a first tamper-proof layer 208 and a second opaque layer 210 according to one embodiment. In one embodiment, the print data 200, the raised tactile data 202 and/or the indented tactile data 204 may together form the tactile data pattern 206 (e.g., as illustrated in FIG. 4A). The print data 200 may be information (e.g., information related to a lottery, a game of chance, banking password, etc.) printed on a substrate (e.g., a substrate 300 of FIG. 3A) of the scratch media 100. The raised tactile data 202 and the indented tactile data 204 may be in the form of a braille character (e.g., a braille character 408 of FIG. 4B), an alphanumerical character (e.g., an alphanumerical character 410 of FIG. 4B), a numerical character, and/or a tangible data (e.g., a tangible data 412 of FIG. 4B) according to one embodiment. The raised tactile data 202 and/or the indented tactile data 204 may be useful to a special-needs user (e.g., a visually challenged user) to interpret (e.g., translate and/or understand) the information (e.g., information related to a lottery, a game of chance, banking password, etc.) associated to the tactile data pattern 206.

The first tamper-proof layer 208 may be one of the layers of the plurality of layers that cover (e.g., coat) the print data 200, the raised tactile data 202, and/or the indented tactile data 204 to prevent tampering of the tactile data pattern according to one embodiment. The first tamper-proof layer 208 may allow tamper detection (e.g., based on a continuity study of the layer, coating the tactile data pattern to detect any manipulation and/or foul play) of the tactile data pattern 206, when the scratch media 100 is subjected to inspection (e.g., with the help of a UV light). In one embodiment, the second opaque layer 210 may be one of the layers of the plurality of layers that cover the first tamper proof layer 208, the print data 200, the raised tactile data 202 and/or the indented tactile data 204 to prevent detection of the tactile data pattern 206. The application of the second opaque layer 210 may render the tactile data pattern 206 undetectable (e.g., through touch and/or through vision).

Figure 3A:
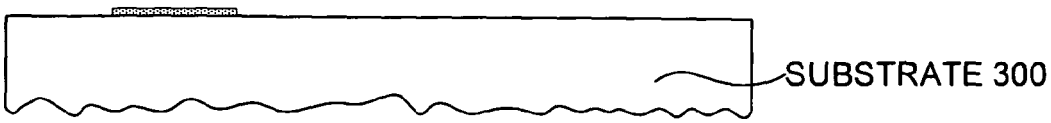
Figure 3B:
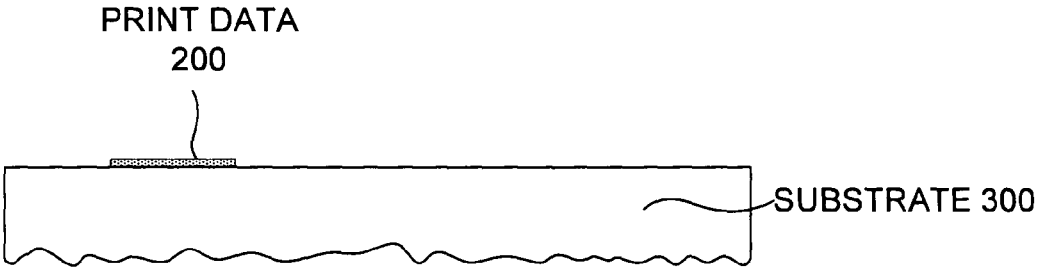
Figure 3C:
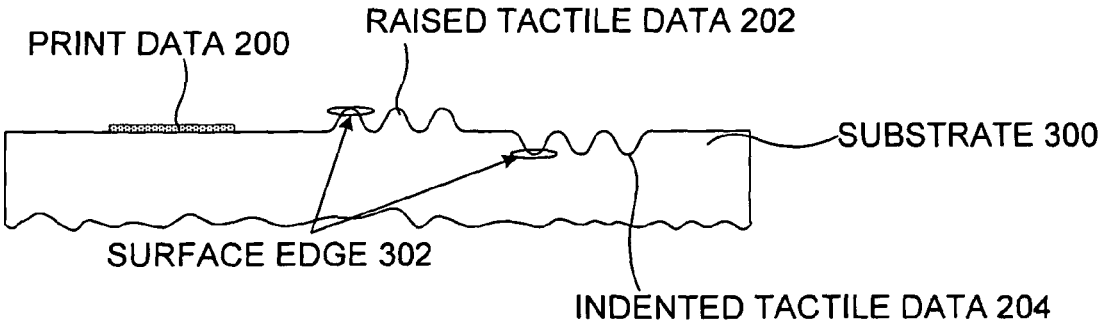
Figure 4A:
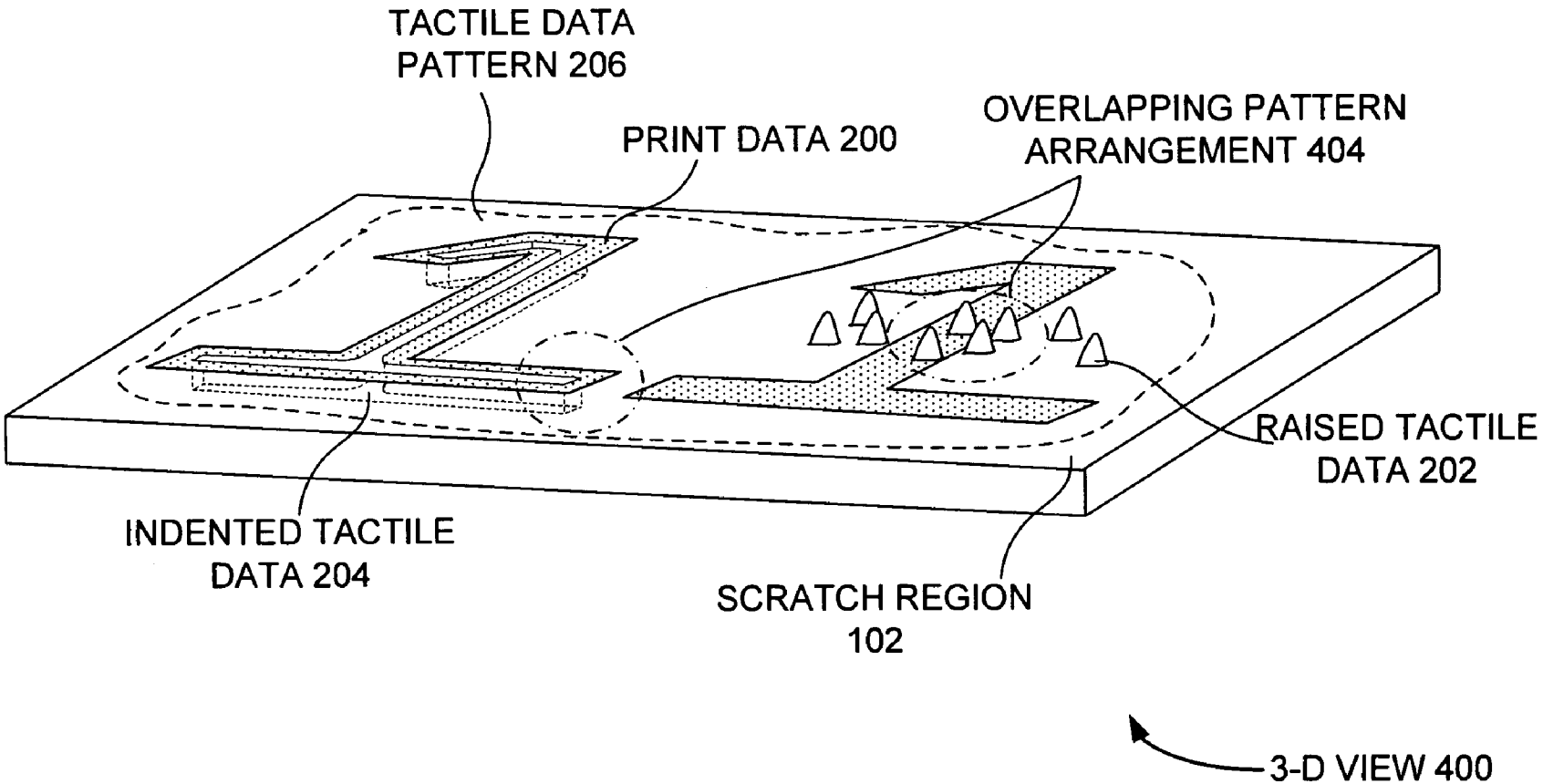
FIG. 4A is a dimensional view of the scratch region of FIG. 1 for an overlapping pattern arrangement of the tactile data pattern, according to one embodiment.

FIG. 3A-3E are process diagrams illustrating fabrication of the scratch region (e.g., the scratch region 102 of FIG. 1) on the scratch media 100, according to one embodiment. First, FIG. 3A illustrates the substrate 300 (e.g., a card substrate, a metal substrate, etc.). In FIG. 3B a print data (e.g., the print data 200 of FIG. 2) is printed on the substrate (e.g., the substrate 300 of FIG. 3A). Next, in FIG. 3C, a raised tactile data (e.g., the raised tactile data 202 of FIG. 2) and/or an indented tactile data (e.g., the indented tactile data 204 of FIG. 2) is created on the substrate 300 to produce a tactile data pattern (e.g., the tactile data pattern 206 of FIG. 2) on the scratch region (e.g., the scratch region 102 of FIG. 1). The raised tactile data 202 and/or the indented tactile data 204 may be created based on an application of an etching technique, an indenting technique and/or an embossing technique on the substrate 300 (e.g., the substrate 300 of FIG. 3A), according to one embodiment. In one embodiment the raised tactile data 202 and/or the indented tactile data 204 may be created in a manner such that a surface edge 302 (e.g., as illustrated in FIG. 3C) of the raised tactile data 202 and/or the indented tactile data 204 is curved (e.g., to prevent accumulation of debris).

Then, in FIG. 3DI-3DII, a first tamper-proof layer (e.g., the first tamper proof layer 208 of FIG. 2) is applied above the tactile data pattern 206. The first tamper-proof layer 208 may be applied in different manners. In FIG. 3DI, a mask layer 304 may be used as the first tamper-proof layer 208 to coat the tactile data pattern 206 (e.g., in the form of a thin film). Alternately, in FIG. 3DII, a fill layer 306 may be used as the first tamper-proof layer 208 to fill (e.g., pack) the tactile data pattern 206 (e.g., in the form of a filling and/or stuffing layer). The first tamper-proof layer 208 may cover the print data 200, the raised tactile data 202 and/or the indented tactile data 204 of the tactile data pattern 206. Then, in FIG. 3EI-3EII, a second opaque layer (e.g., the second opaque layer 210 of FIG. 2) is applied above the first tamper-proof layer 208 and above the tactile data pattern 206, according to one embodiment. FIG. 3EI illustrates the application of the second opaque layer 210 when the first tamper-proof layer 208 is the mask layer 304. FIG. 3EII illustrates the application of the second opaque layer 210 when the first tamper-proof layer 208 is the fill layer 306. The application of the second opaque layer 210 may be subsequent to the application of the first tamper-proof layer 208, according to one embodiment. In one embodiment, thickness of the second opaque layer 210 may be greater than a thickness of the raised tactile data 202 (e.g., the raised tactile data 202 of FIG. 2) to prevent detection of the tactile data pattern 206 (e.g., by touch). The first tamper-proof layer 208 and the second opaque layer 210 may be a chemical agent (e.g., a resin and/or an adhesive) with appropriate properties (e.g., binding properties) to facilitate application on the scratch region 102.

Figure 4B:
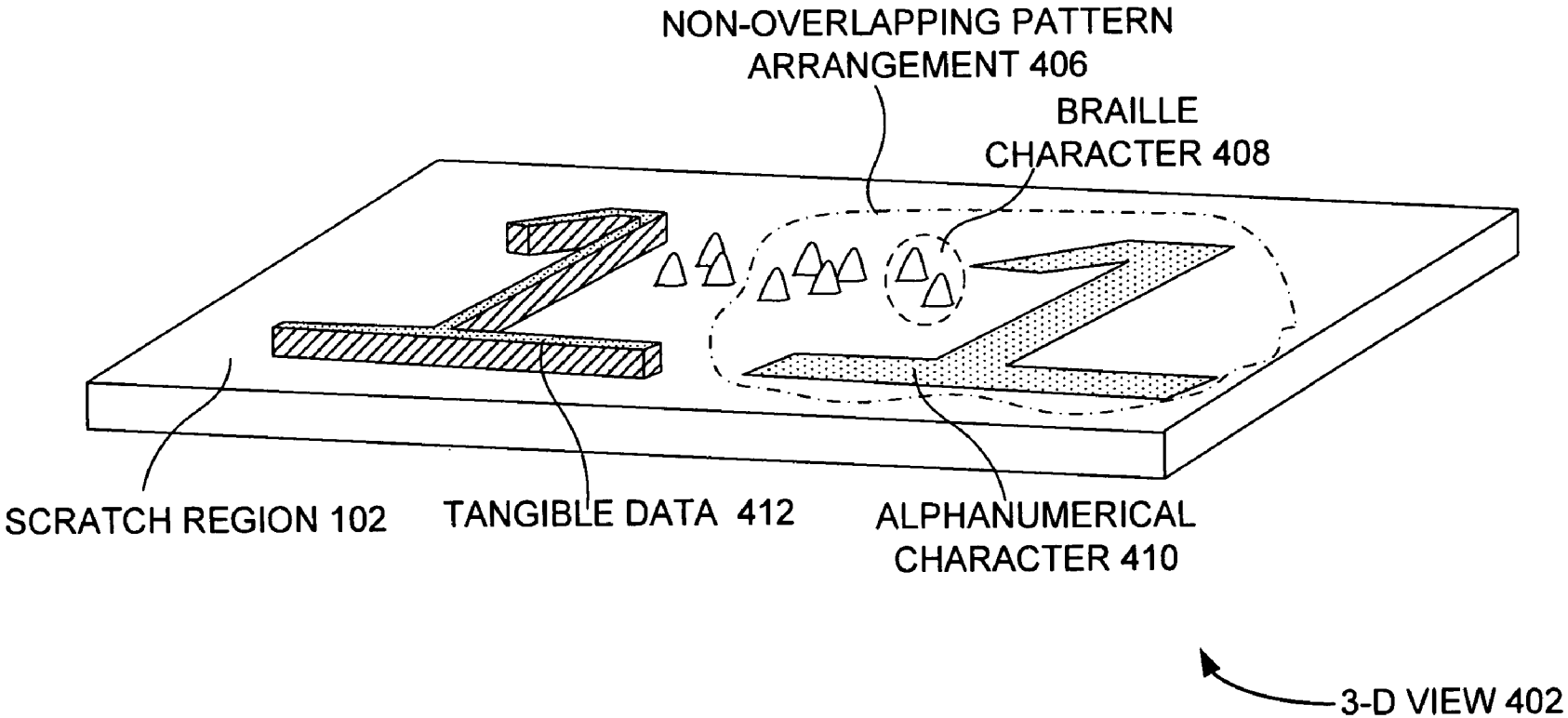
FIG. 4B is a three-dimensional view of the scratch region of FIG. 1 for a non-overlapping pattern arrangement of the tactile data pattern, according to one embodiment.

FIG. 4A and FIG. 4B are three-dimensional views of the scratch region 102 of FIG. 1 having the tactile data pattern 206. FIG. 4A is a three-dimensional view 400 of the scratch region 102 of FIG. 1 showing an overlapping pattern arrangement 404 of the tactile data pattern 206 (e.g., the tactile data pattern 206 of FIG. 2). In one embodiment the overlapping pattern arrangement 404 may be based on a combination of the print data 200 and the raised tactile data 202 and/or the indented tactile data 204. For example, the overlapping pattern arrangement 404 may be based on the combination of the print data 200 and the raised tactile data 202 (as illustrated in FIG. 4A). Alternatively, the overlapping pattern arrangement 404 may be based on the combination of the print data 200 and the indented tactile data 204 (as illustrated in FIG. 4A).

FIG. 4B is a three-dimensional view 402 of the scratch region 102 of FIG. 1 showing a non-overlapping pattern arrangement 406 of the tactile data pattern 206 (e.g., the tactile data pattern 206 of FIG. 2), the braille character 408, the alphanumerical character 410 and the tangible data 412. The non-overlapping pattern arrangement 406 may be based on a combination of the print data 200 and the raised tactile data 202 and/or the indented tactile data 204, according to one embodiment. For example the non-overlapping pattern arrangement 406 may be based on the combination of print data (e.g., the alphanumerical character 410) and the raised tactile data (e.g., the braille character 408). The braille character 408 may be useful to a special-needs user (e.g., a visually challenged user) to interpret (e.g., translate and/or understand) the information (e.g., information related to a lottery, a game of chance, banking password, etc.) associated to the tactile data pattern 206. The tangible data 412 may be information represented in the form of a tangible medium (e.g., a shape, a contour of an object, etc.).

Figure 5:
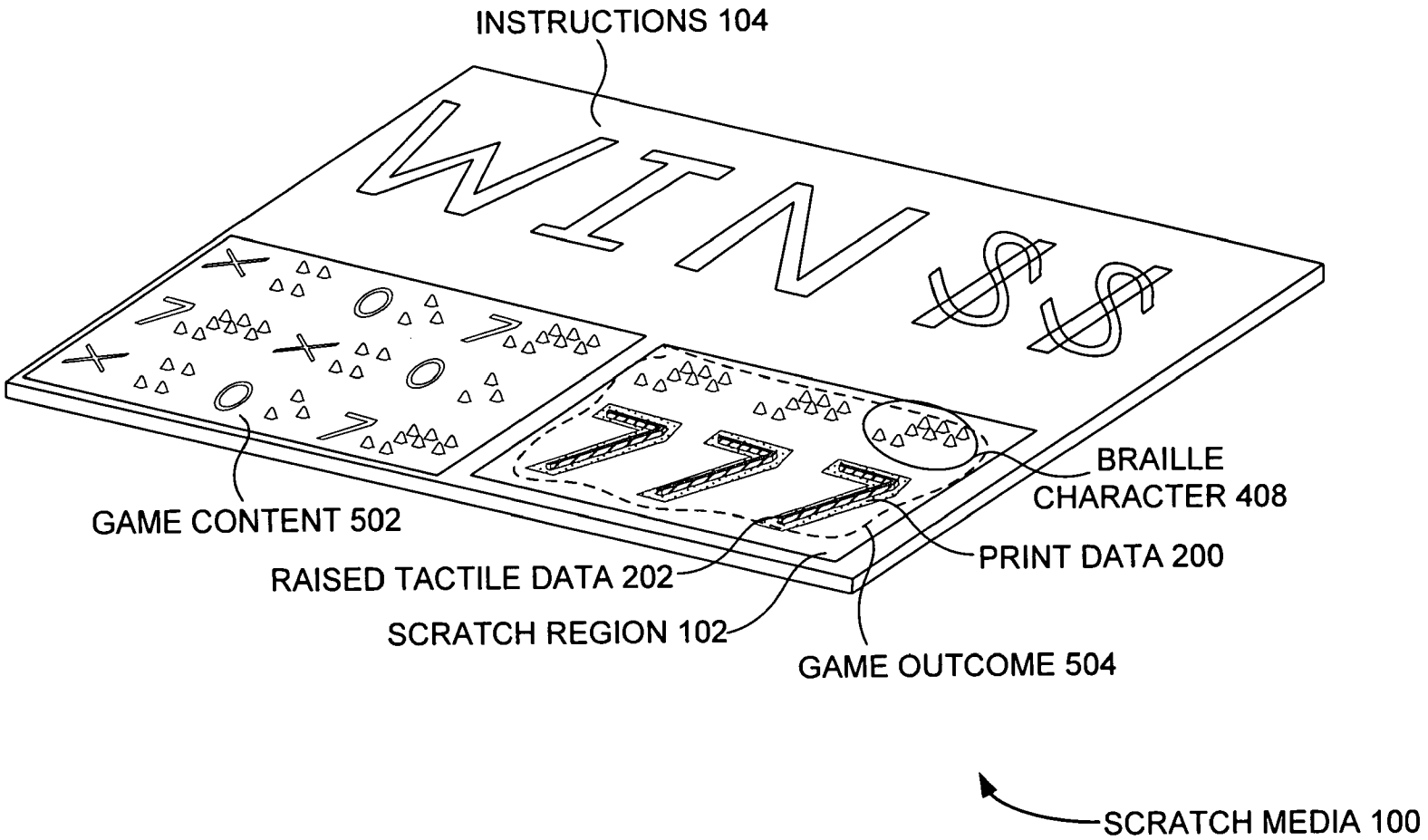
FIG. 5 is a dimensional view of the scratch media of FIG. 1 having a game outcome associated to the tactile data pattern, according to one embodiment.

FIG. 5 is a three-dimensional view 500 of the scratch media 100 (e.g., the scratch media 100 of FIG. 1) having a game content 502 and a game outcome 504 on the scratch region 102 (e.g., the scratch region 102 of FIG. 1). The game content 502 may be attributes of a game (e.g., a lottery, a game of chance, a skill game, etc.) provided on the scratch media 100. In one embodiment, a method of conducting a game (e.g., a game of chance, lottery, etc.) may include a system to provide the scratch media (e.g., the scratch media 100 of FIG. 1) having the tactile data pattern (e.g., the tactile data pattern 206 of FIG. 2) to disclose the game outcome 504 (e.g., result of the game) to the user (e.g., the player) and to verify a winner (e.g., winner of the game) based on a validation (e.g., verification) of the game outcome 504 associated to the tactile data pattern 206.

The validation of the game outcome 504 may be based on a comparison of an optical evaluation (e.g., visual assessment) of the print data 200 with a tactile evaluation (e.g., assessment by touch) of the raised tactile data 202 and/or the indented tactile data 204 of the tactile data pattern 206, according to one embodiment. For example, in FIG. 5, the game outcome 504 includes a print data (e.g., 777 printed on the scratch region) and a raised tactile data (e.g., 777 in braille and in a raised form). The game outcome 504 may be validated through a comparison of the print data (e.g., 777 printed on the scratch region which may be visualized optically) to the raised tactile data (e.g., 777 in braille and in the raised form which may be detected by touch).

Figure 6:
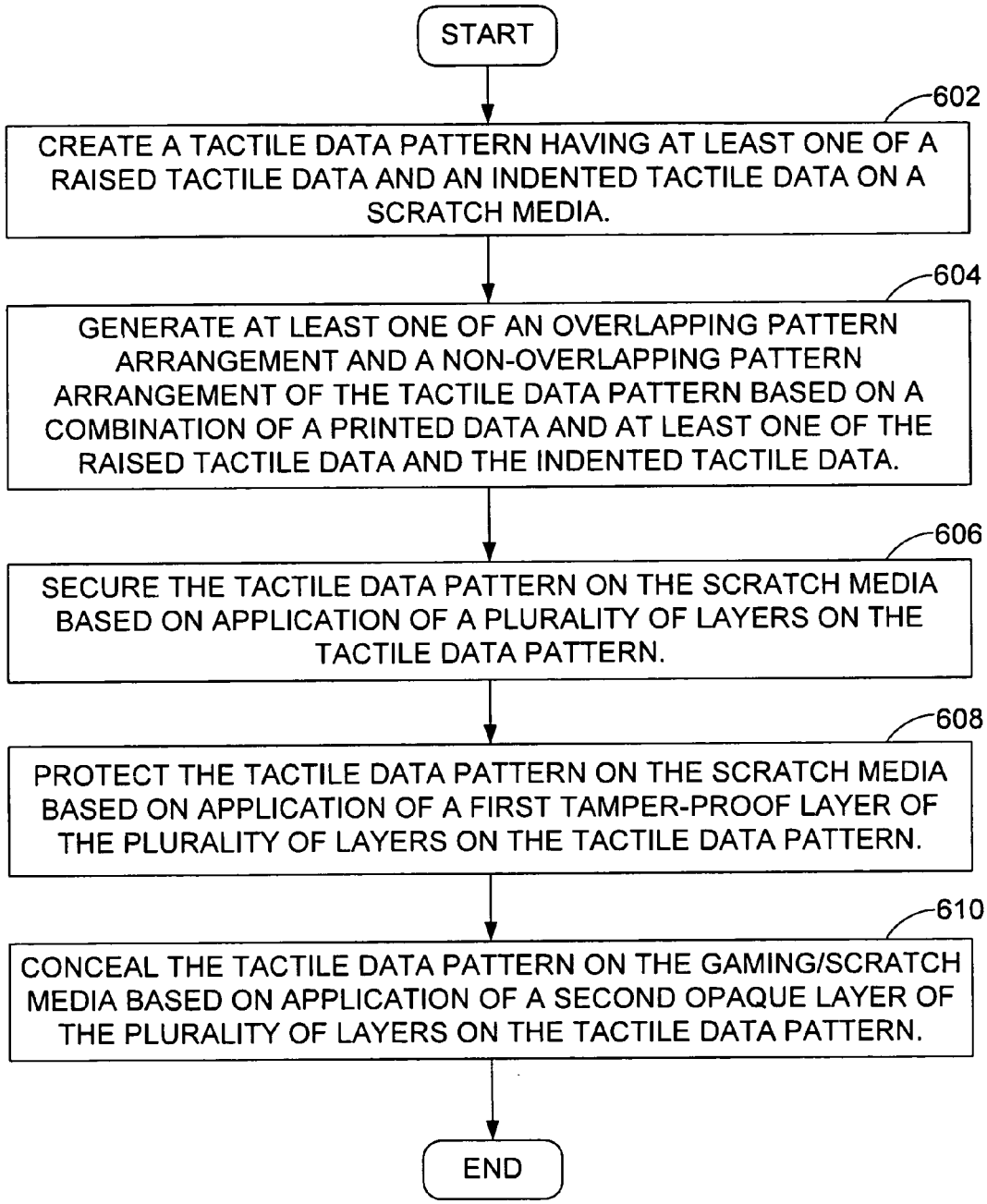
FIG. 6 is a flow chart to create and secure the tactile data pattern on the scratch media, according to one embodiment.

FIG. 6 is a flow chart to create and secure the tactile data pattern (e.g., the tactile data pattern 206 of FIG. 2) on the scratch media (e.g., the scratch media 100 of FIG. 1), according to one embodiment. In operation 602, a tactile data pattern (e.g., the tactile data pattern 206 of FIG. 2) having at least one of a raised tactile data (e.g., the raised tactile data 202 of FIG. 2) and an indented tactile data (e.g., the indented tactile data 204 of FIG. 2) may be created (as illustrated in FIG. 3C) on a scratch media (e.g., the scratch media 100 of FIG. 1). In operation 604, at least one of an overlapping pattern arrangement (e.g., the overlapping pattern arrangement 404 of FIG. 4A) and a non-overlapping pattern arrangement (e.g., the non-overlapping pattern arrangement 406 of FIG. 4B) of the tactile data pattern may be generated based on a combination of a print data (e.g., the print data 200 of FIG. 2) and at least one of the raised tactile data and the indented tactile data. In operation 606, the tactile data pattern on the scratch media may be secured based on an application of a plurality of layers on the tactile data pattern.

In operation 608, the tactile data pattern on the scratch media may be protected based on an application of a first tamper-proof layer (e.g., the first tamper-proof layer 208 of FIG. 2) of the plurality of layers on the tactile data pattern (as illustrated in FIG. 3DI and in FIG. 3DII). In operation 610, the tactile data pattern on the scratch media may be concealed (e.g., undetectable to touch and/or to vision) based on an application of a second opaque layer (e.g., the second opaque layer 210 of FIG. 2) of the plurality of layers on the tactile data pattern (as illustrated in FIG. 3EI and in FIG. 3EII).

Figure 7:
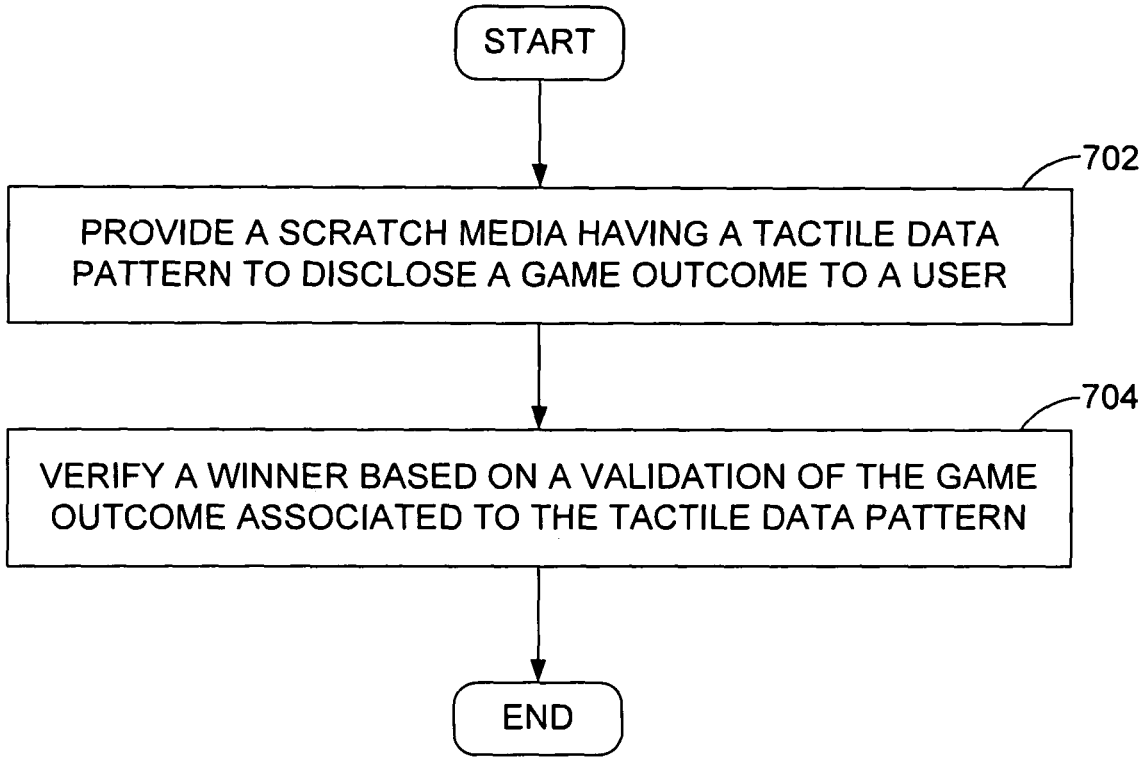
FIG. 7 is a flow chart to validate a game outcome associated to the tactile data pattern on the scratch media, according to one embodiment.

FIG. 7 is a flow chart to validate a game outcome (e.g., the game outcome 504 of FIG. 5) associated to the tactile data pattern (e.g., the tactile data pattern 206 of FIG. 2) on the scratch media (e.g., the scratch media 100 of FIG. 1) according to one embodiment. In operation 702, a scratch media (e.g., the scratch media 100 of FIG. 1) having a tactile data pattern (e.g., the tactile data pattern 206 of FIG. 2) may be provided to disclose a game outcome (e.g., the game outcome 504 of FIG. 5) to a user (e.g., a player). In operation 704, a winner (e.g., winner of the game) may be verified based on a validation of the game outcome associated to the tactile data pattern (as described in FIG. 5).

Although the present embodiments have been described with reference to specific example embodiments, it will be evident that various modifications and changes may be made to these embodiments without departing from the broader spirit and scope of the various embodiments. For example, the various regions, instructions, layers, etc. described herein may be enabled and operated using a variety of materials, substances, methods, and machinery. In addition, some of the instructions disclosed herein may be performed by hardware circuitry (e.g., CMOS based logic circuitry), firmware, software and/or any combination of hardware, firmware, and/or software (e.g., embodied in a machine readable medium).

In addition, it will be appreciated that the various operations, processes, and methods disclosed herein may be embodied in a machine-readable medium and/or a machine accessible medium compatible with a data processing system (e.g., a computer system), and may be performed in any order. Accordingly, the specification and drawings are to be regarded in an illustrative rather than a restrictive sense.

What is claimed is:

1. An apparatus, comprising:

a scratch media having a tactile data pattern to provide information to a user; and a scratch region on the scratch media having a plurality of layers that conceal the tactile data pattern, wherein the tactile data pattern includes at least one of a raised tactile data and an indented tactile data, wherein the raised tactile data and the indented tactile data is at least one of a braille character, an alphanumerical character and a tangible data, wherein surface edge of the at least one of the raised tactile data and the indented tactile data of the tactile data pattern is curved, wherein the tactile data pattern is arranged according to at least one of an overlapping pattern arrangement and a non-overlapping pattern arrangement, wherein arrangement of the overlapping pattern arrangement and the non-overlapping pattern arrangement is based on a combination of a print data and at least one of the raised tactile data and the indented tactile data, wherein a first tamper-proof layer of the plurality of layers covers at least one of the print data, the raised tactile data and the indented tactile data to prevent tampering of the tactile data pattern, and wherein the first tamper-proof layer is at least one of a mask layer and a fill layer, wherein a second opaque layer of the plurality of layers covers at least one of the first tamper-proof layer, the print data, the raised tactile data and the indented tactile data to prevent detection of the tactile data pattern, and wherein thickness of the second opaque layer is greater than a thickness of the raised tactile data.

2. A method comprising:

creating a tactile data pattern having at least one of a raised tactile data and an indented tactile data on a scratch media; and securing the tactile data pattern on the scratch media based on application of a plurality of layers on the tactile data pattern, wherein the tactile data pattern is created based on application of at least one of an etching technique, an indenting technique, a printing technique and an embossing technique on the scratch media;

generating at least one of an overlapping pattern arrangement and a non-overlapping pattern arrangement of the tactile data pattern based on a combination of a print data and at least one of the raised tactile data and the indented tactile data;

protecting the tactile data pattern on the scratch media based on application of a first tamper-proof layer of the plurality of layers on the tactile data pattern, wherein application of the first tamper-proof layer is on top of at least one of the print data, the raised tactile data and the indented tactile data; and concealing the tactile data pattern on the scratch media based on application of a second opaque layer of the plurality of layers on the tactile data pattern, wherein application of the second opaque layer is subsequent to application of the first tamper-proof layer, wherein application of the second opaque layer is on top of at least one of the first tamper-proof layer, the print data, the raised tactile data and the indented tactile data.

* * * * *